US006517890B2

(12) United States Patent
Denecke et al.

(10) Patent No.: US 6,517,890 B2
(45) Date of Patent: Feb. 11, 2003

(54) THIN LAYER PREPARATION FOR RADIONUCLIDE SOURCES

(75) Inventors: Bruno Denecke, Mol (BE); Tamas Szabo, Mol (BE)

(73) Assignee: European Community, Luxembourg (LU)

( * ) Notice: Subject to any disclaimer, the term of this patent is extended or adjusted under 35 U.S.C. 154(b) by 0 days.

(21) Appl. No.: 09/789,700

(22) Filed: Feb. 22, 2001

(65) Prior Publication Data

US 2002/0136836 A1 Sep. 26, 2002

(51) Int. Cl.[7] ..... B05D 3/12; B05D 3/04; B05D 3/02; B05D 5/00

(52) U.S. Cl. ..... 427/5; 427/240; 427/346; 427/348; 427/350; 427/378

(58) Field of Search ..... 427/5, 240, 346, 427/348, 350, 378

(56) References Cited

U.S. PATENT DOCUMENTS 4,113,492 A * 9/1978 Sato et al. ..... 96/67
5,652,013 A * 7/1997 Patch et al. ..... 427/2.11
6,086,942 A * 7/2000 Carden et al. ..... 427/5

OTHER PUBLICATIONS

Denecke et al., "Improvements in Quantitative Source Preparation", Applied Radiation and Isotopes, vol. 52, Mar. 2000, pp. 351–355.*

* cited by examiner

*Primary Examiner*—Michael Barr
(74) *Attorney, Agent, or Firm*—Gary M. Nath; Todd L. Juneau; Joshua B. Goldberg

(57) ABSTRACT

Method of thin layer preparation for a radionuclide source comprising the following steps:

Figure 1:
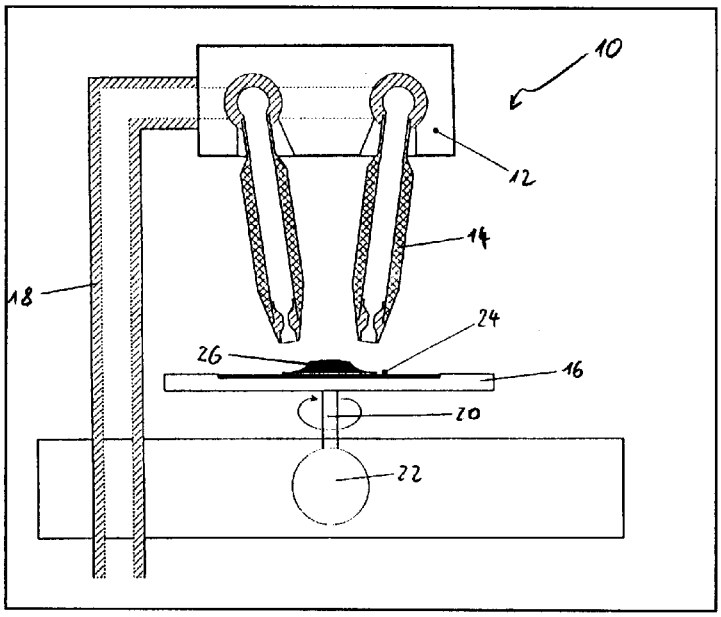

deposition of a drop of a radionuclide dissolved in a solvent onto a on a support substrate, placing said support substrate with said drop in a confined space with a reduced pressure, directing at least one flow of a hot gas onto the drop, rotating the source relative to the hot gas jet creating turbulences inside the drop, evaporating the solvent and obtaining a thin layer of dry radionuclide.

9 Claims, 2 Drawing Sheets

THIN LAYER PREPARATION FOR RADIONUCLIDE SOURCES

INTRODUCTION

Methods of thin layer preparation for radionuclide sources have been a subject of many publications and review articles (Van der Eijk, W., Oldenhof, W. and Zehner, W. <<Preparation of thin sources, a review>> Nud. Instr. and Meth. 112 (1973) 343; Lowenthal, G. C. and Wyllie, H. A. "Special methods of source preparation". Nucl. Instr. and Meth. 112 (1973) 353). Amongst the applied techniques are: electrolytic or electrophoretic deposition, evaporation, sputtering or sublimation under vacuum, direct spraying or painting, precipitation and self transfer or drying of a liquid drop directly deposited on a substrate. Only the last method can be used for quantitative source preparation. All other methods require an independent determination of the deposition yield and hence, cannot be regarded as absolute source preparation methods.

Standardization of the activity concentration of radionuclide solutions by some important methods requires the preparation of solid samples with known amounts of the radioactive substance on a suitable substrate. The deposits should also be stable, well defined and rigidly bonded to the substrate. A uniform distribution of the source material over a large area on the supporting substrate minimizes self-absorption.

In most cases, drying of a liquid drop of a radioactive solution results in an agglomeration of crystals, the final size of which depends mainly on the time available for the crystals to grow The usual practice, as described by Van der Eijk and Zehner, in "Preparation of thin sources for absolute beta-counting" Radiochimica Acta 24, 205 (1977), was to dry the sources in a fume hood by the air draft.

The results were often unsatisfactory since large crystals were formed mainly at the boundary of the drop and at dust particle inclusions. In some cases the liquid withdrew to a much smaller area than the initial drop size, resulting in a very inhomogeneous distribution of the deposit.

The uniformity of the deposit was improved by stirring the drop with a dry nitrogen jet (Wyllie, H. A., Johnson, E. P. and Lowenthal, G. C. <<A procedure for stirring aliquots of radioactive solutions when making thin 4π counting sources>>. Int. J. Appl. Radiat. Isot. Vol 21,497 (1970)). However, due to the long drying time of typically 10 to 20 minutes, crystals could still grow to large sizes.

OBJECT OF THE INVENTION

The object of the present invention is to provide a method and a device to prepare a thin and uniform deposit on a solid substrate by accelerated drying of a droplet of a solution containing dissolved crystalline material so as to obtain a solid residue as thin and uniform as possible, firmly bonded to the substrate without loss of dissolved matter.

GENERAL DESCRIPTION OF THE INVENTION

In order to overcome the above mentioned problem, the present invention provides a method of thin layer preparation for a radionuclide source comprising the following steps:

- deposition of a drop of a radionuclide dissolved in a solvent onto a on a substrate,
- placing said drop in a confined space with a reduced pressure,

- directing at least one flow of a hot gas onto the drop,
- rotating the source relative to the hot gas jet creating turbulences inside the drop,
- evaporating the solvent and obtaining a thin layer of dry radionuclide.

The method allows to prepare a thin and uniform deposit of a radionulcide or any other crystalline product on a solid substrate by accelerated drying of a drop of a solution containing dissolved radionulcide or crystalline material so as to obtain a solid residue as thin and uniform as possible, firmly bonded to the substrate without loss of dissolved matter.

According to a preferred embodiment the flow of a hot gas is lowered as the solvent is evaporated. It is also recommended to lower the temperature of the hot gas flow is lowered as the solvent is evaporated. Preferably, the temperature of the hot gas is varied from about 200° C. to about 50° C. For example, the temperature of the hot gas may be lowered to about 50° C. as soon as about 70 to 90% of the solvent is evaporated. In general, the temperature of the gas flow is not critical.

In a preferred embodiment, at least four flows of hot gas are directed onto said drop and the hot gas flows are spaced symmetrically around said drop. At the beginning of the drying process, the gas flow can be moved from a stand-by position outside said drop towards just inside said drop boundary. The gas flow hit said drop preferably at four diametrically opposite positions so as to keep said drop safely confined.

In order to accelerate the method further, the gas flow is regulated in such a way that a depression is created in the drop and that said the depression does not reach the support substrate.

According to another aspect of the invention an Apparatus for thin layer preparation for a radionuclide source is proposed. The apparatus comprises:

- block means with a moving mechanism,
- heatable gas injector means movably fixed to said block means,
- turntable means mounted on a shaft of a motor, said turntable means comprising a space for removably fixing a support means for said radionuclide source;
- bell jar means connected to a vacuum pump for applying a reduced pressure to said bell jar means, said bell jar means covering said turntable means and said gas injector means.
- said block means is supported by supporting means comprising power and gas supply means for said gas injector means;
- said block means is mounted above said turntable in such a way that said gas injector means are directed towards said support means for said radionuclide source.

The motor may be e.g. a geared asynchronous motor using frequency control to vary rotation speed from 5 to 150 rpm.

According to another aspect of the invention, the gas injector means comprise four gas injectors placed symmetrically with an inclination in a distance above said turntable. Said distance between the gas injector means and the turntable as well as the inclination of the gas injectors are adjustable.

DETAILED DESCRIPTION OF THE INVENTION

Figure 2:
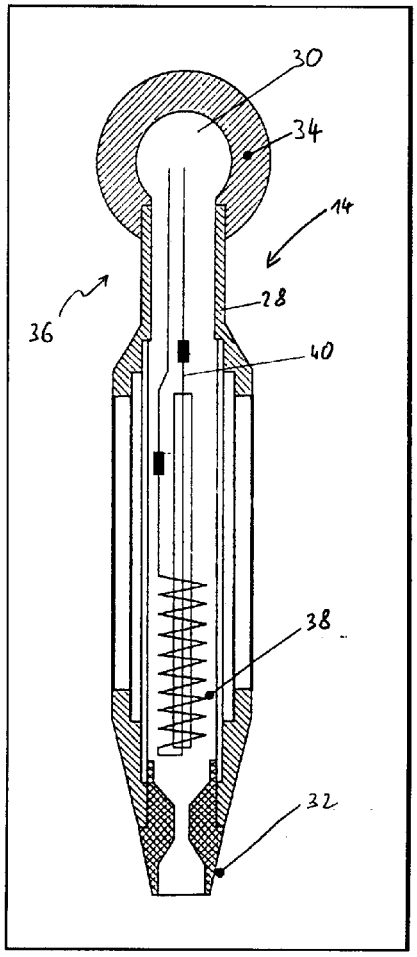
Figure 3:
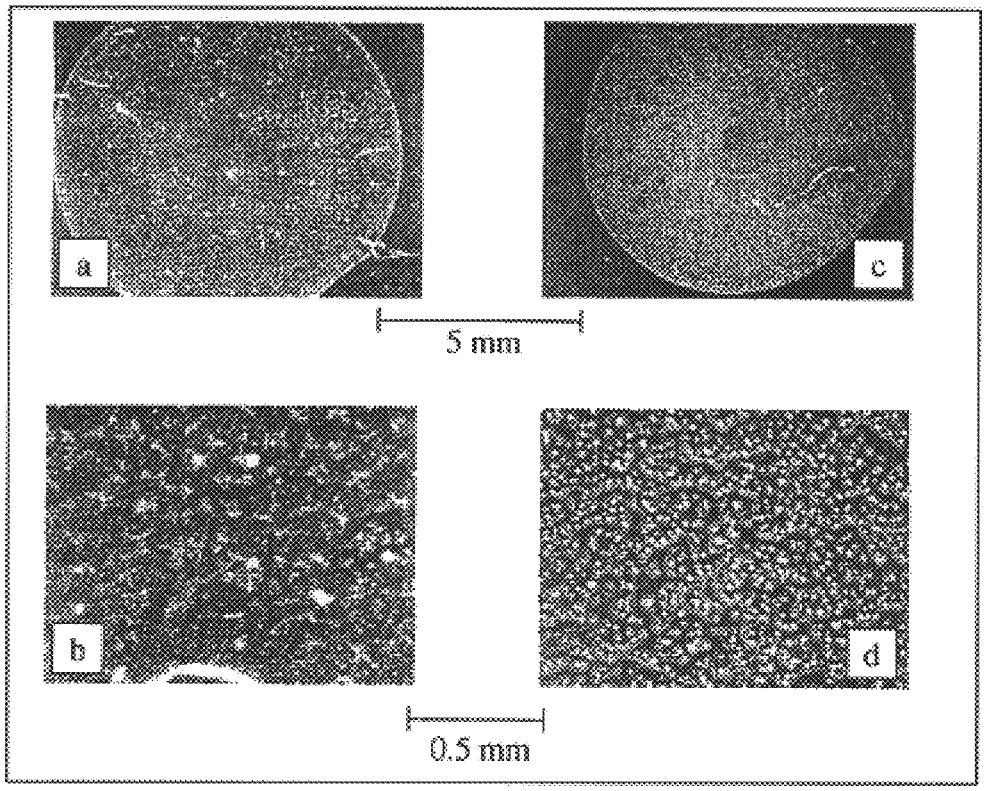
Figure 4:
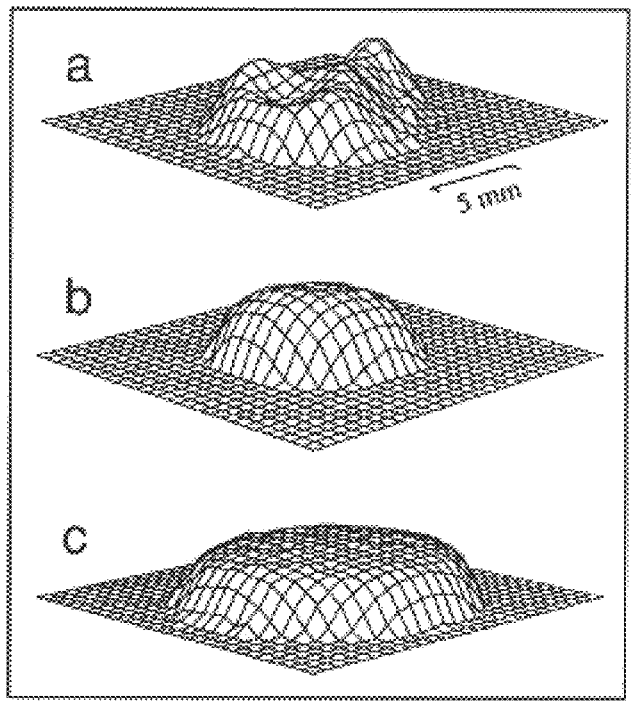

The present invention will be more apparent from the following description of not limiting embodiments with reference to the attached drawings, wherein FIG. 1 shows a schematic drawing of the device according to a preferred embodiment of the invention, FIG. 2 shows the cross section of the hot gas injectors, FIG. 3 represents microphotographs documenting crystal size and distribution of two $TINO_3$ deposits: (a) and (b) dried according to the described prior art method, (c) and (d) drying accelerated by the new drying device, FIG. 4 represents contour maps of the shape and activity distribution of $^{237}Np$ sources obtained from scanning of autoradiographs. The sources were prepared by: (a) drying according to the described prior art method, (b) drying accelerated by the new drying device and (c) sublimation of $^{237}NpF_4$ under vacuum.

Quantitative sources are prepared by drying a drop of known mass of the radioactive solution on various supporting substrates. First, a seeding agent of diluted colloidal silica (LUDOX form E.I. DuPont de Nemours & Co (Inc.) Chemicals and Pigments Dept Wilmington, Del. USA) is deposited on the substrate. In case of a hydrophobic surface, like chromium-plated glass, a wetting agent is used to extend the drop size. Finally, a liquid drop of the radionuclide solution is dispensed from a polyethylene pycnometer onto the substrate. Drop masses ranging from 10 to 50 mg can be determined with an accuracy of approximately 5 $\mu$g by weighing the pycnometer before and after drop dispense.

The drying apparatus 10 as represented on FIG. 1 comprises a block 12 with a moving mechanism and four movable gas injectors 14 (two of which are shown). The block 12 is mounted above a turntable 16 on a supporting tube 18 which is also the power and gas supply duct of the gas injectors 14. The turntable 16 is covered by a bell jar (not shown) and attached to a vacuum pump (not shown).

The turntable 16 is directly mounted on the shaft 20 of a geared asynchronous motor 22 using frequency;control to vary the rotation speed from 5 to 150 rpm.

The source substrate 24 with the deposited drop 26 of radionuclide dissolved in a solvent (mainly water), carried on a circular transport tray, is centered on the turntable 16 over the shaft 20. The top of the turntable is then covered by the bell jar (not shown) and pumping is started to reach a pre-set pressure of about 10 kPa. In the meantime, rotation is started at a low speed to prevent a possible asymmetric liquid drop to sling off from the center. Finally, the gas injectors 14 are moved from a stand-by position outside the drop 26 towards just inside the drop boundary and start to stir the liquid. The gas jets hit the drop 26 at four diametrically opposite positions and keep the liquid safely confined in the center. The depression in the drop surface should not reach the supporting substrate; otherwise additional three-phase boundaries would be created inside the drop, which disturbs the uniform drying.

As the drop reduces in size, the rotation speed is increased for better stirring of the liquid and the temperature of the gas jets is reduced to avoid overheating of the drop. Mixing of the now already concentrated liquid layer is continuing. By adapting the impact positions of the gas jets to the shape of the liquid layer one can keep the liquid evenly spread. Fast rotation of the turntable and movements of the jets are continued until a uniform dry deposit is obtained.

To confine drops 26 of various sizes at the center of the spinning substrate 24 the four gas injectors 14 placed concentric above the turntable 16 are engaged. They are mounted diametrically opposed to each other and can be moved simultaneously. The gas jets emitted by the gas injectors 14 cause turbulence within the drop 26 and stir the remaining liquid during drying.

Only two of the four gas injectors 14 are shown. All four gas injectors 14 are mounted symmetrically into a supporting block 12 that conducts the drying gas and contains the supply cables for the heating power. The distance between the gas injectors 14 and the turntable 16 and the inclination of the gas injectors 14 are adjustable. The inclination and the distance of the gas injectors 14 with respect to the source plane, and hence their impact positions on the drop 26, can be remotely controlled during the drying process. The operator is able to observe the drying process through the transparent bell jar. He can adapt the position of the gas injectors 14 to meet the drop size and vary the nitrogen flow rate and temperature externally.

Placing a bell jar over the turntable 16 creates a closed and dust-free environ- ment around the drop source 26. Pumping is needed to remove the water vapor from the closed recipient and allows to control the pressure between 5 kPa and 101.3 kPa, which additionally accelerates the evaporation.

All gases introduced into the bell jar are filtered to ensure that no dust particles contaminate the source.

The immediate removal of the saturated vapor from the drop 26 surface by the jet blows and subsequent extraction by the vacuum pump reduces the drop drying time to a few minutes. Due to the drastically reduced crystal growing time, the resulting deposit consists of a large number of small crystals that are uniformly distributed over the initial area of the drop size. Such deposits are comparable to layers formed by vacuum sublimation, one of the best but non-quantitative deposit-preparation methods (FIG. 3). The turbulence and stirring prevents the accumulation of large crystals at the three-phase boundary between the drop 26 and the substrate 24 around the drying source, which guarantees a clean environment excluding dust particles to merge with the source material during the drying process.

Intense evaporation begins when the temperature and the flows of the gas jet are set high. In this phase, mainly water evaporates and only a film of the concentrated acid solution and remains on the substrate. At this point, the heat input to the gas jets can be reduced to limit the temperature rise of the deposit and substrate and to reduce the build-up of material stresses in the deposit. These stresses may tear a thin foil substrate or reduce adherence between the deposit and the substrate.

The maximum temperature of the gas flow depends mainly on the substrate 24. The temperatures must be regulated in such a way that the substrate is not damaged. In case the substrate is made of plastic material the temperatures must be lower than for substrates made of glass.

The gas injectors 14 are shown in more detail in FIG. 2. The gas injector 14 comprises a gas duct 28 having an inlet 30 and an outlet or nozzle 32. A hinge 34 to mount the gas injectors 14 into the supporting block 12 is fitted on the Lipper end 3,6 of the gas duct 28. Inside the gas duct 28 is placed a heating element 38 consisting of a helix of resistive wire on a glass tube core 40 placed close to the nozzle 32 of the injector 14. Two thin-walled tubes thermally insulate the gas duct 28.

The gas jets formed by the narrow nozzle 32 of the gas injectors 14 at an elevated temperature are impacting directly onto the rotating liquid drop 26 deposited on a substrate 24. A sensor to monitor the temperature of the gas flow is attached to the nozzle 32

To increase the temperature of the gas jets emitted by the gas injectors 14 up to 200° C., electric heating elements 38 made of helical resistance wire 40 are placed close to the nozzle 30 of the injectors 14.

To reduce a temperature drop at the relatively low gas-flow rate of about 300 $cm^3$ $min^{-1}$, thermal insulation of the gas duct 28 was necessary. A prompt response of the gas jet temperature to changes of the heating power input was obtained by minimizing all masses in contact with the heated gas. The nozzle 32 shape was optimized to form gentle impacts of the gas jets on the drop surface.

By using multiple gas jets at an elevated temperature and rotating the source at the same time the evaporation of the solvent was accelerated substantially and turbulences were caused within the drop. This turbulence prevented the formation of a few large crystals at the three-phase boundary between the drop and the substrate. As a result of the steady remixing, a large number of small crystals, uniformly distributed over the original drop size, were formed.

The homogeneous distribution of the source material was confirmed by qualitative and quantitative methods. The quality of the layers, concerning the crystal size and distribution, was:documented by microphotographs of TINO3 deposits taken with a stereo microscope (FIG. 3). Concentration at the boarder of the deposit and few crystals of up to 80 $\mu$m were found in normally dried deposits FIGS. 3*a* and 3*b*). A much better distribution and crystals smaller than 10 $\mu$m were found when the accelerated drying technique according to the invention was used (FIGS. 3*c* and 3).

The uniformity of the activity distribution of different $^{237}$Np sources was documented by autoradiography using 3H-sensitive films at a distance of 0.3 mm from the source. The films were exposed for various times to trace also low-activity spots on the sources and to stay within the linear range of the emulsions. A subsequent scanning of the autoradiographs and plotting of the contour maps revealed the shape and distribution of the deposits quantitatively (FIG. 4).

A sensitive quality indicator of the crystal size was found in the low-energy tailing seen in the peak shape of a particle spectra of $^{237}$Np sources also used for the autoradiographs of FIG. 4. A figure of merit was obtained from the peak-fitting parameters of a spectrum deconvolution as described by Babeliowsky T. and Bortels G., 1993. ALFA: <<A program for accurate analysis of complex alpha-particle spectra on a PC>>; Appl. Radiat. Isot. 44, 1349) using a Gaussian peak shape combined with two exponential tails as a model. Energy absorption and straggling of the alpha particles in the source material does not affect the Gaussian peak width , $\sigma$, but it increases the value of both exponential tails, $\tau_1$, and $\tau_2$ drastically. In table 1, the shape parameters are given in channels;: each channel corresponds to 0.6 keV. All shape parameters of the two $^{237}$Np drop sources, also used for the autoradiographs of FIG. 4, were compared with those of a $^{237}NpF_4$ source produced by vacuum sublimation, one of the best available, however, non-quantitative source preparation methods (see Table 1). The improvement of the deposit quality is clearly seen in both tail parameters. The FWHM is less sensitive to the source thickness and uniformity since it is a convolution of the individual peak-shape parameters.

TABLE 1

| | Peak shape parameters | | | | | |
|---|---|---|---|---|---|---|
| Source type | Gauss shape $\sigma$ | Short tail $\tau_1$ | Long tail $\tau_2$ | Tail weight ratio $\eta$ | FWHM | Source activity Bq |
| Normal drying | 4.3 | 51 | 300 | 0.13 | 33.3 | 318 |
| Accelerated drying | 4.56 | 15.5 | 93 | 0.23 | 15.1 | 1463 |
| Vacuum sublimation | 4.23 | 5.32 | 25.4 | 0.06 | 9.28 | 444 |

The results obtained with the new accelerated drying technique are very encouraging. Sources could be dried in less than 3 minutes, which is shorter than the drop weighing and deposition time. The quality and production speed of quantitative source preparation were significantly improved. Of importance is also the closed volume. It is recommended to place the dried sources immediately into a desiccator to avoid the absorption of water and to prevent recrystallisation, which increases self-absorption, in particular when the deposits are hygroscopic.

Reference List

| | |
|---|---|
| 10 | Drying apparatus |
| 12 | Supporting block |
| 14 | Gas injectors |
| 16 | turntable |
| 18 | Supporting tube |
| 20 | Shaft |
| 22 | motor |
| 24 | Substrate |
| 26 | Drop |
| 28 | Gas duct |
| 30 | Inlet |
| 32 | outlet or nozzle |
| 34 | Hinge |
| 36 | Upper end |
| 38 | Heating element |
| 40 | Heating wire |

What is claimed is:

1. Method of thin layer preparation for a radionuclide source comprising the following steps:

deposition of a drop of a radionuclide dissolved in a solvent onto a support substrate, placing said support substrate with said drop in a confined space with a reduced pressure, directing at least one flow of a hot gas onto the drop, wherein the temperature of said flow of hot gas is varied from about 200° C. to about 50° C., rotating the source relative to the hot gas jet creating turbulences inside the drop, evaporating the solvent and obtaining a thin layer of dry radionuclide having a thickness of up to 80 $\mu$m.

2. The method according to claim 1 wherein said flow of a hot gas is lowered as the solvent is evaporated.

3. The method according to claim 1 wherein the temperature said flow of hot gas is lowered as said solvent is evaporated.

4. The method according to claim 1 wherein the temperature of said hot gas is lowered to about 50° C. as soon as about 90% of said solvent is evaporated.

5. The method according to claim 1 wherein at least four flows of hot gas are directed onto said drop.

6. The method according to claim 5 wherein the hot gas flows are spaced symmetrically around said drop.

7. The method according to claim 1, wherein said gas flow is moved from a stand-by position outside said drop towards inside said drop boundary.

8. The method according to claim 1, wherein said gas flow hits said drop at four diametrically opposite positions so as to keep said drop confined.

9. The method according to claim 1 wherein said gas flow is regulated in such a way that a depression is created in said drop and that said depression does not reach said support substrate.

* * * * *